United States Patent [19]

Shiratsuchi et al.

[11] Patent Number: 4,592,316

[45] Date of Patent: Jun. 3, 1986

[54] AIR FUNNEL ASSEMBLY

[75] Inventors: Kouji Shiratsuchi, Saitama; Hiroshi Nakano, Tokyo, both of Japan

[73] Assignee: Honda Giken Kogyo Kabushiki Kaisha, Tokyo, Japan

[21] Appl. No.: 622,795

[22] Filed: Jun. 21, 1984

[30] Foreign Application Priority Data

Jun. 29, 1983 [JP] Japan ..... 58-117830
Jun. 29, 1983 [JP] Japan ..... 58-117831

[51] Int. Cl.[4] ..... F02M 35/12

[52] U.S. Cl. ..... 123/195 C; 123/195 A; 123/198 E; 55/385 B; 181/229

[58] Field of Search ..... 123/198 E, 195 C, 195 A; 181/204, 229; 55/385 B

[56] References Cited

U.S. PATENT DOCUMENTS 3,249,172 5/1966 De Lorean ..... 181/229
3,800,910 4/1974 Rose ..... 181/229
4,224,919 9/1980 Appelbaum ..... 123/198 E
4,319,657 3/1982 Nomura ..... 181/229
4,364,340 12/1982 Kimura ..... 55/385 B

*Primary Examiner*—Ira S. Lazarus
*Attorney, Agent, or Firm*—Lyon & Lyon

[57] ABSTRACT

An air funnel assembly extending between an air inlet assembly and one or more carburetors on a two-wheeled vehicle. The air funnel assembly includes an elastic air funnel and an air funnel cover. The funnel and funnel cover are affixed to the carburetor or carburetors and extend in spaced relation towards the air inlet assembly. The components may be fixed to the carburetors by means of one or more clamp rings, may be additionally joined together by projections from the elastic funnel which are retained in holes in the rigid cover. A radially interlocking arrangement may be employed at the inlet from the air inlet assembly to retain the funnel thereto.

6 Claims, 8 Drawing Figures

AIR FUNNEL ASSEMBLY

BACKGROUND OF THE INVENTION

The field of the present invention is air intake systems for internal combustion engines and air passage systems therefor.

Internal combustion engines employed on vehicles and particularly on two wheel vehicles such as motorcycles and the like are generally designed without sufficient body panels or surrounds for covering the engine and attendant mechanisms. In the case of air cooled engines, it is even advantageous to have the engine substantially exposed for heat dissipation purposes. Consequently, components of such vehicles generally must be designed with such exposure in mind, for purposes of durability and aesthetic appearance.

Of particular importance to the foregoing considerations are flexible or elastic products which are typically molded without final finishing and which, in place, are not considered particularly attractive, are exposed to the sun and other elements and may be subjected to substantial abrasion or other wear. As a result, it is desirable to minimize the exposure of such products on such vehicles.

One specific area of concern has been the inlet passageway or air funnel extending between the air inlet, normally including an air filter, and one or more carburetors. An elastic funnel is desirable because air cleaners are typically rigidly mounted to the frames of small, two-wheeled vehicles while the engines are more resiliently mounted thereto. Consequently, the operation of such engines results in movement and vibration of the engines relative to the air inlet systems. As a result, some elasticity must exist between the inlet system and the carburetor in an air funnel assembly. Such funnels also lack an aesthetic appearance and advantageously could be hidden for both aesthetic and durability considerations.

SUMMARY OF THE INVENTION

The present invention pertains to an air funnel assembly employing a cover. The cover is arranged about an elastic air funnel extending between an air inlet and a carburetor on a two wheel vehicle. The cover advantageously conceals the elastic funnel to provide an aesthetically attractive external appearance and protection from the sun and the elements. The funnel itself may then be fabricated without attention to aesthetic considerations.

Such a cover may also aid in the mounting and support of the resilient air funnel. The cover is preferably displaced from the funnel due to the need for elasticity in the funnel itself. However, mechanisms may be employed for the mutual support and attachment of the elastic air funnel and the air funnel cover. Projections may extend outwardly from the elastic air funnel for attachment to the air funnel cover. Such projections help locate the air funnel cover and at the same time prevent the elastic air funnel from collapsing upon rapid opening of the carburetor throttle valve. A longitudinal slit may be provided in the cover at one end thereof, which end is positioned about the elastic funnel such that a clamp ring may securely retain the two components at the carburetor. At the other end of the air funnel assembly, the elastic funnel may be radially interlocked with the intake to avoid funnel collapse or may include an annular, longitudinal extending groove for receipt of the rigid cover.

Accordingly, it is an object of the present invention to provide an improved air funnel assembly for two wheel vehicles. Other objects and advantages will appear hereinafter.

DETAILED DESCRIPTION OF THE PREFERRED EMBODIMENT

Figure 1:
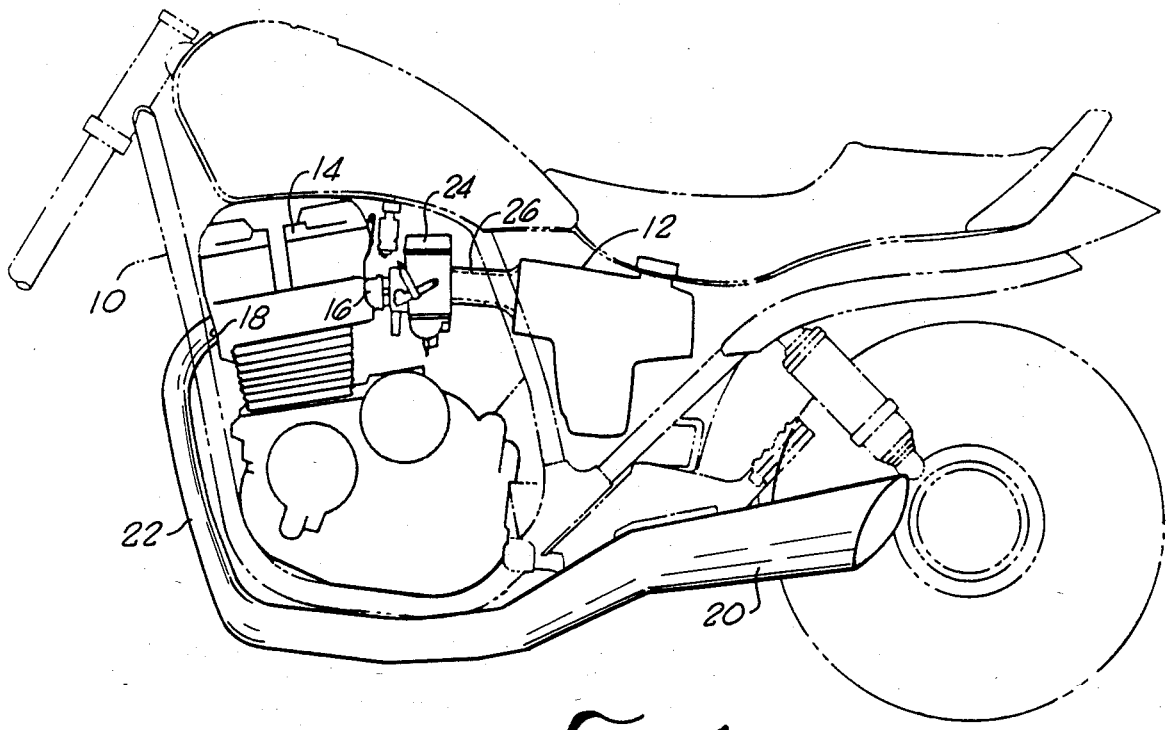
FIG. 1 is a side elevation of a two wheel vehicle employing an air inlet system, a carburetor and an air funnel assembly therebetween.
Figure 2:
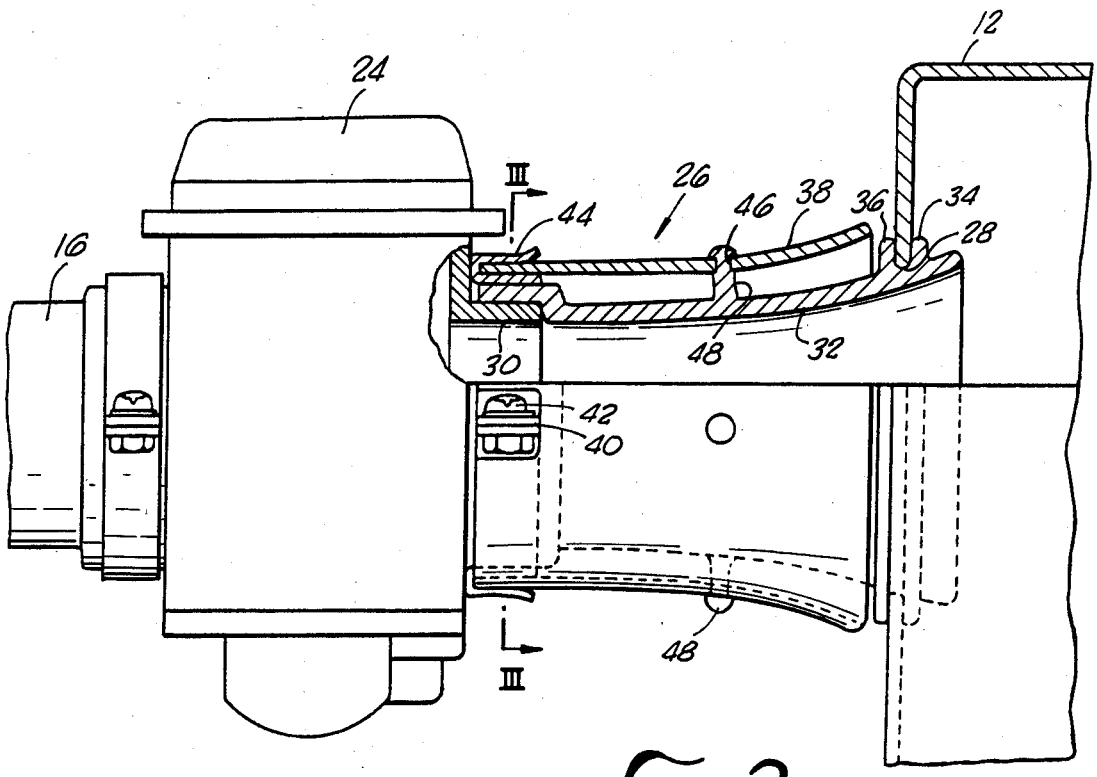
FIG. 2 is a side elevation, partially in cross section, illustrating a first embodiment of an air funnel assembly of the present invention.

Turning in detail to the drawings, FIG. 1 illustrates a typical environment for the present invention. A motorcycle, generally illustrated in phantom, includes a frame 10. Affixed to the frame 10 is an air inlet assembly 12 which is securely fastened to the frame 10. In the present embodiment, the air inlet assembly 12 is illustrated as being an air filter assembly. Also affixed to the frame is an engine 14. The engine 14 is more resiliently mounted to the frame 10 to reduce the transmission of vibrations and the like from the engine to the frame. The engine is illustrated as including an intake 16, an exhaust outlet 18, a muffler 20 coupled with the exhaust outlet 18 through an exhaust pipe 22 and a carburetor 24 coupled with the engine intake 16.

Arranged between the carburetor 24 and the air inlet assembly 12 is an air funnel assembly 26. The air funnel assembly 26 is illustrated as spanning the distance between the air filter 12 and the inlet to the carburetor 24.

FIGS. 2–5 illustrate a first embodiment of the present invention. The air inlet assembly 12 is shown to provide a hole 28 in a panel for receipt of the air funnel assembly 26. The carburetor includes a cylindrical flange 30 extending toward the air inlet assembly 12 for mounting of the air funnel assembly 26. The spacing between the air inlet assembly 12 and the carburetor 24 depends upon the arrangement and location of components on the motorcycle itself. The arrangement illustrated in this first embodiment includes two carburetors 24 associated with a multicylinder engine. Consequently, the air funnel assembly 26 is divided into two passages at the carburetor but extends to a single inlet at the air inlet assembly 12.

The air funnel assembly 26 includes an elastic air funnel 32 which is divided into two passages for association with the two carburetors 24. The funnel 32 defines two cylindrical ports at a first end thereof to fit over the cylindrical flanges 30 of the carburetors 24. At the other end of the elastic air funnel 32, the opening 28 is generally rectangular as can best be seen in FIG. 3. Two radially extending flanges 34 and 36 extend outwardly from the funnel 32 to define a channel therebetween for receipt of the periphery of the hole 28. In this way, both ends of the elastic air funnel 32 are associated with the components of the motorcycle.

Figure 3:
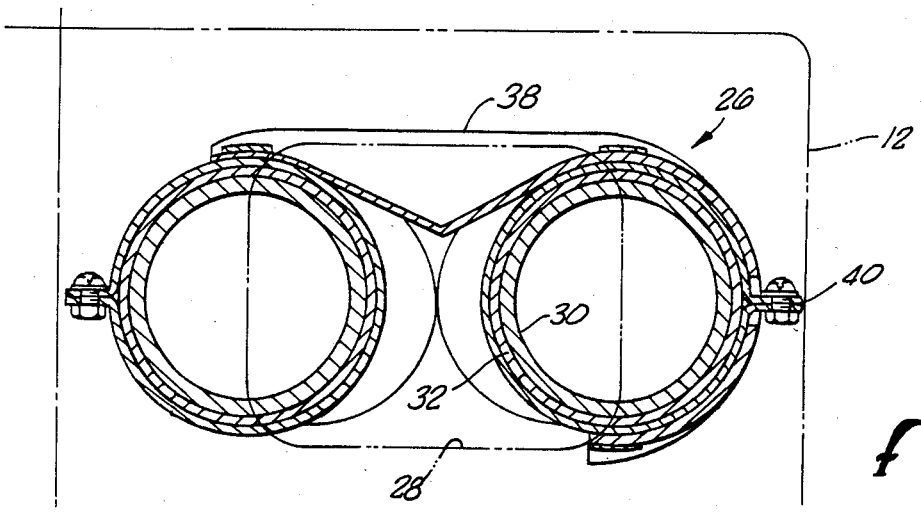
FIG. 3 is a cross sectional elevation taken along line III—III.
Figure 4:
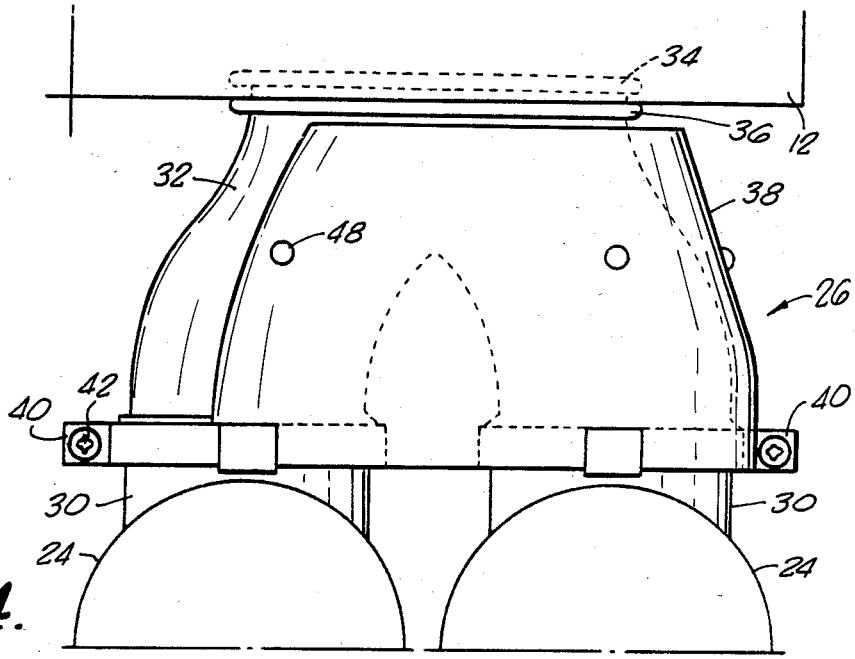
FIG. 4 is a plan view of the embodiment of FIG. 2.
Figure 5:
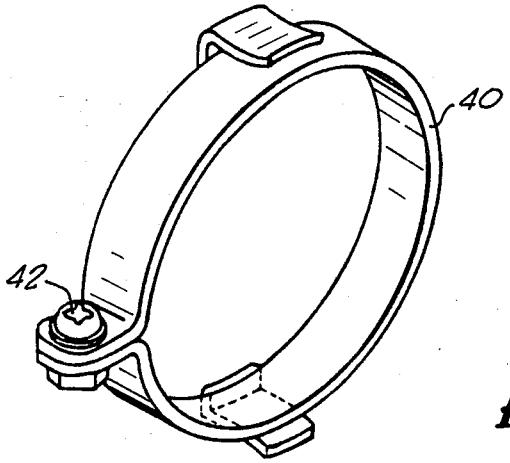
FIG. 5 is an oblique view of a clamp ring of the embodiment of FIG. 2.

Extending about a portion of the elastic air funnel 32 is an air funnel cover 38. The air funnel cover 38 extends from adjacent the uppermost portion of the funnel above one passageway leading to the carburetor 24, spans across the funnel 32 and is wrapped around one side of the funnel 32 to the bottom of the funnel adjacent the other passageway. This is best illustrated in FIG. 3. The nonsymmetrical arrangement is employed because of the exposure of only one side of the funnel to the external portion of the motorcycle.

The air funnel cover 38 may be of either a rigid plastic material or metal, giving a pleasing and substantial aesthetic appearance. Additionally, such materials are better able to resist decomposition from the sun, abrasion and other affects of the environment.

The air funnel cover 38 may also provide structural support for the funnel assembly. At a first end of the air funnel cover 38 and of the elastic air funnel 32, both components are structurally held relative to the carburetors 24. A clamp ring 40 is employed about each cylindrical flange 30 on the carburetor with the elastic air funnel 32 held therebetween. Each clamp ring 40 may include a longitudinal split where a fastener 42 is able to draw the clip together to place the ends of the elastic air funnel 32 in compression about the cylindrical flanges 30 of the carburetor 24. Clips 44 at appropriate locations about the clamp rings 40 receive the rigid air funnel cover 38 such that it is positioned about but generally spaced from the elastic air funnel except at the first end.

The rigidly extending air funnel cover 38 includes holes 46 therethrough for receipt of upstanding projections 48 molded to the surface of the air funnel 32. The projections 48 generally include a head and neck portion for engagement of the holes 46. In this way, the elastic air funnel 32 is structurally supported so that it will tend not to collapse upon rapid opening of the throttle valve of the engine.

Figure 6:
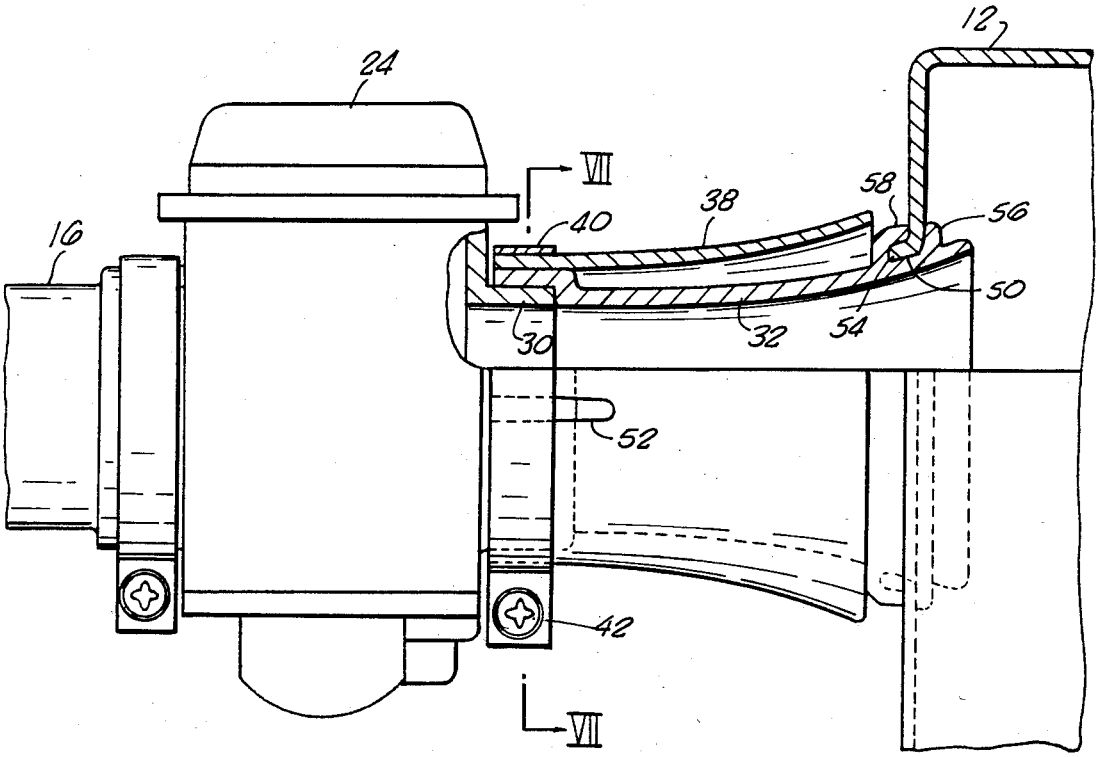
FIG. 6 is a side elevation, partially in cross section of a second embodiment of an air funnel assembly of the present invention.
Figure 7:
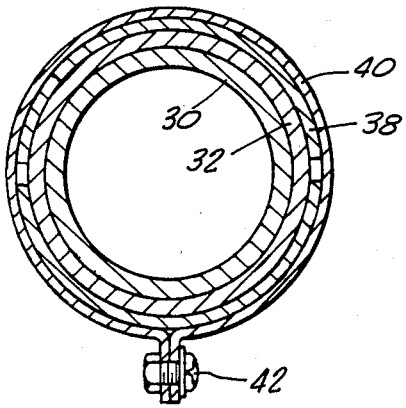
FIG. 7 is a cross sectional elevation taken along line VII—VII of FIG. 6.

Looking next to the embodiment of FIGS. 6 and 7, identical reference numerals are employed for identical or functionally similar components. A single carburetor 24 is employed in this embodiment. Consequently, the elastic air funnel 32 generally extends in a cylindrical manner from the cylindrical carburetor flange 30 to a circular hole 50 in the air inlet assembly 12. The first end of the elastic air funnel 32 at the carburetor 24 is generally mounted about the cylindrical flange 30 as in the first embodiment. The air funnel cover 38 is cylindrical at the first end and fits over the full circular extent of the funnel 32. The cover 38 includes a longitudinal split 52 extending from the first end to provide the ability to expand and contract diametrically. A clamp ring 40 is then positioned about the funnel 32 and cover 38 and drawn tightly thereabout by means of a fastener 42.

At the other end of the funnel 32, the hole 50 in the air inlet assembly 12 includes an axially extending flange 54. The axially extending flange 54 fits within an undercut channel defined by radially extending flanges 56 and 58 on the funnel 32. As a result, the elastic air funnel 32 is radially interlocked with the air inlet assembly 12 at the flange 54. This interlocking aids in the prevention of air funnel collapse upon rapid opening of the throttle valve. This problem is also minimized in this second embodiment because the elastic air funnel 32 is generally circular in cross section throughout rather than extended through a roughly rectangular configuration as in the first embodiment.

Figure 8:
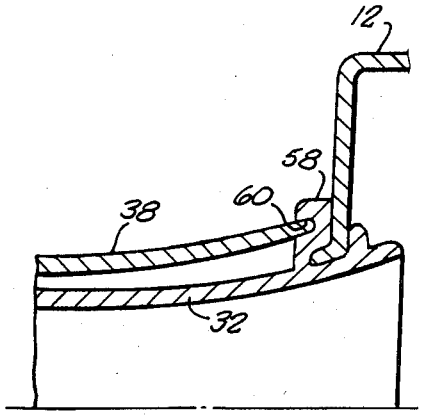
FIG. 8 is a detailed cross-sectional elevation of a modification of the embodiment of FIG. 6 illustrating the attachment at the air inlet.

FIG. 8 illustrates a modification of the embodiment of FIGS. 6 and 7. In this modification radially extending flange 58 includes an annular, longitudinally extending groove 60 within which the second end of the air funnel cover 38 is positioned. This arrangement provides further rigidity to the system if such is found to be of benefit.

Thus, improved air funnel assemblies for two-wheeled vehicles extending between an air inlet assembly and one or more carburetors is here disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. An air funnel assembly between an air inlet and a carburetor, comprising an elastic air funnel extending between the inlet and the carburetor;

an air funnel cover extending about at least a portion of said elastic air funnel, said air funnel cover being rigid, said elastic air funnel including projections extending outwardly to said air funnel cover and being attached thereto.

2.The air funnel assembly of claim 1 wherein said elastic air funnel is branched to join with two carburetors, said air funnel covers spanning across said branched air funnel.

3. The air funnel assembly of claim 1 wherein said air funnel cover includes holes therethrough and said projections being attached at said holes.

4. The air funnel assembly of claim 1 further comprising a clamp ring at the carburetor securely surrounding a first end of said elastic air funnel and having clips for receipt of one end of said air funnel cover about said clamp ring.

5. The air funnel assembly of claim 1 wherein said elastic air funnel includes an annular, longitudinally extending groove at an end thereof at the carburetor, an end of said air funnel cover extending to engage said groove.

6. An air funnel assembly between an air inlet and a carburetor for a two-wheeled vehicle, comprising an elastic air funnel extending between the air inlet and the carburetor, said elastic air funnel being radially interlocked with said air inlet at one end of said elastic air funnel;

an air funnel cover extending about said elastic air funnel between said carburetor and said air inlet, said air funnel cover including a longitudinal slit at a first end;

a clamp ring securely fixed about said first end of said air funnel cover and the other end of said elastic air funnel at said carburetor.

* * * * *